US006135828A

United States Patent [19]

Lalange et al.

[11] Patent Number: 6,135,828

[45] Date of Patent: Oct. 24, 2000

[54] SHORT CIRCUIT TERMINAL AND CONNECTOR

[75] Inventors: Jacques Lalange, Pontoise; Pascal Seguin, Soisy-sous-Montmorency, both of France

[73] Assignee: The Whitaker Corporation, Wilmington, Del.

[21] Appl. No.: 09/136,946

[22] Filed: Aug. 20, 1998

[30] Foreign Application Priority Data

Aug. 29, 1997 [FR] France ..... 97 402024

[51] Int. Cl.[7] ..... H01R 4/48

[52] U.S. Cl. ..... 439/862; 439/188

[58] Field of Search ..... 439/862, 856, 439/857, 852, 188, 510–513

[56] References Cited

U.S. PATENT DOCUMENTS

| | | | |
|---|---|---|---|
| 4,978,311 | 12/1990 | Oda et al. | 439/188 |
| 5,055,058 | 10/1991 | Nagasaka et al. | 439/188 |
| 5,368,494 | 11/1994 | Lai | 439/188 |
| 5,494,450 | 2/1996 | Kirsch et al. | 439/188 |
| 5,672,073 | 9/1997 | Matsumura et al. | 439/489 |

FOREIGN PATENT DOCUMENTS

| | | | |
|---|---|---|---|
| 0 367 173 A1 | 5/1990 | European Pat. Off. | H01R 13/703 |
| 0 389 779 A2 | 10/1990 | European Pat. Off. | H01R 13/703 |
| 0 616 397 A2 | 9/1994 | European Pat. Off. | H01R 31/08 |
| 29 03 896 C2 | 11/1990 | Germany | H01R 13/71 |
| 2 245 775 | 1/1992 | United Kingdom | H01R 13/703 |
| WO 93/07662 | 4/1993 | WIPO | H01R 13/703 |

*Primary Examiner*—Paula Bradley
*Assistant Examiner*—Ross Gushi

[57] ABSTRACT

A short circuit terminal has a U-shaped base section formed by a base wall and side walls. Spring contact arms are stamped out of the base wall for short circuiting a pair of terminals arranged in adjacent cavities of a connector housing. The short circuit arms are provided with prestress abutment portions that engage a wall portion of the housing for prestressing the contact arms. The side walls of the base section have cutouts for allowing sliding of secondary locking protrusions through the connector housing.

10 Claims, 3 Drawing Sheets

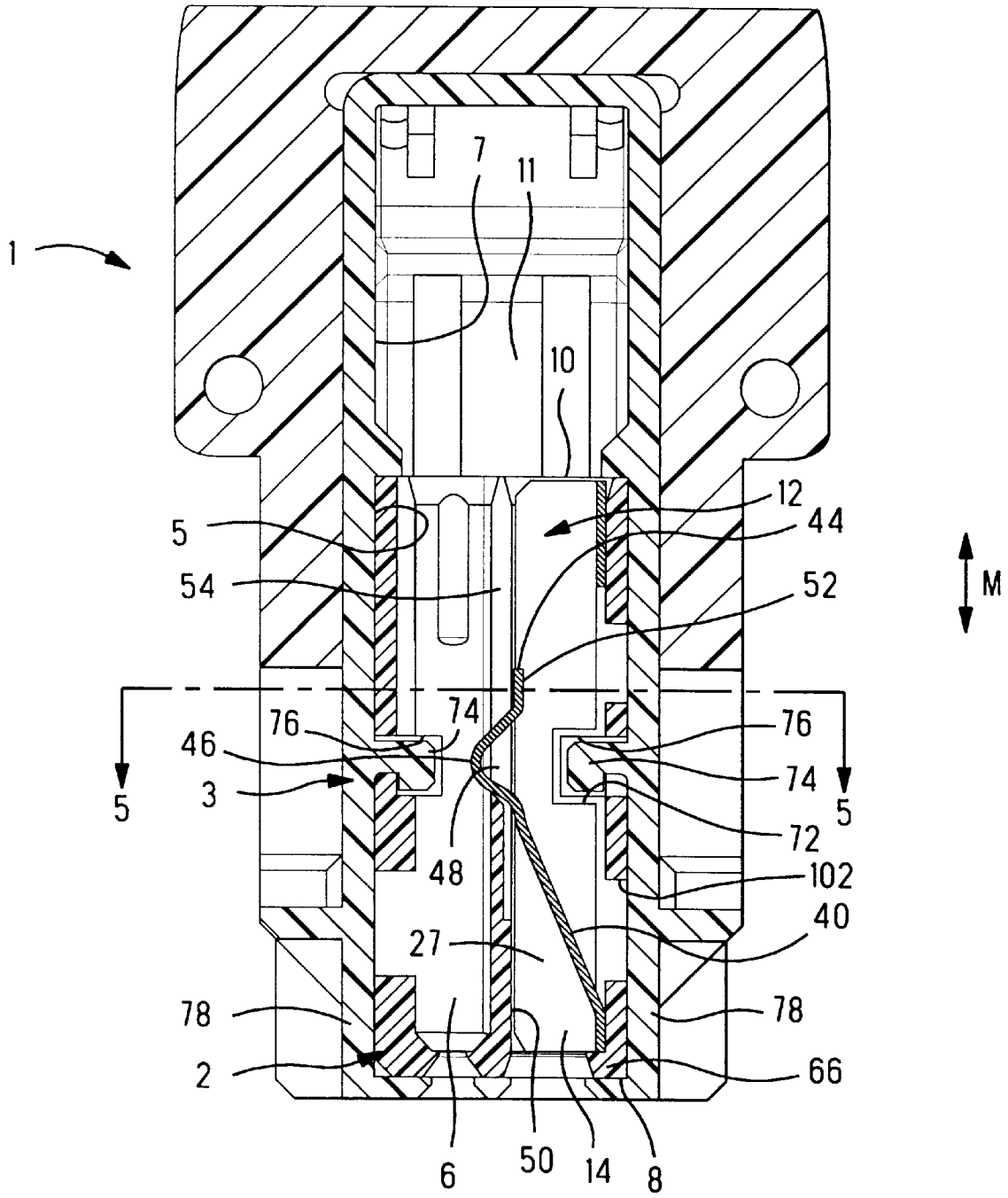
FIG. 4
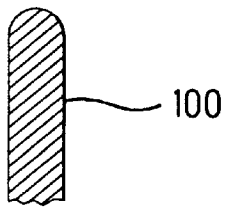

SHORT CIRCUIT TERMINAL AND CONNECTOR

BACKGROUND OF THE INVENTION

1. Field of the Invention

This invention relates to an electrical terminal for short circuiting terminals mounted in a connector housing, the short circuit connection depending on the mating condition of the connector with a complementary connector.

2. Description of the Prior Art

Connectors with short circuit terminals are disclosed for example in DE 29 03 896, U.S. Pat. No. 4,978,311, EP 367 173, EP 389 779 and WO 93/07662. In all of these documents, a short circuit terminal is mounted in a cavity of a connector housing, adjacent a row of terminals mounted in further cavities of the housing. The short circuit terminals have base portions provided with locking lances for secure retention of the short circuit terminal in the connector housing. Extending from the base portion in cantilever fashion, are spring arms having contact protrusions proximate free ends for resiliently biasing against some of the connector terminals. The free ends or springs arms are tapered for receiving a shunt release cam of a complementary connector, for breaking the short circuit connection when the connectors are coupled. A common application for such short circuit terminals is found in the automotive industry, in particular safety restraint systems whereby shorting circuiting of terminals when connectors are unmated reduces the risk of inadvertent ignition of an airbag or seat belt pretensioner.

A particularly safe and reliable connector is thus desirable. One of the disadvantages of prior art short circuit terminals, is that they are relatively voluminous, or do not provide a sufficiently reliable, high contact force against the terminals to be short circuited, or they render secondary locking of terminals of the connector difficult. For example, a short circuit terminal disclosed in WO/9307662 is fairly long and consumes a large amount of sheet metal for the production thereof. In EP 367 173, the short circuit terminal also consumes a lot of sheet metal and because the terminal has opposed contact arms, it is difficult to implement this design in connectors with varying geometries and rows of terminals. The short circuit terminal disclosed in U.S. Pat. No. 4,978,311 is fairly complex, requires a lot of space and also requires large material usage due to the long developed length.

SUMMARY OF THE INVENTION

It is an object of this invention to provide a compact short circuit terminal with low material consumption that nevertheless ensures reliable short circuit contact. It would be further advantageous for the short circuit terminal to be implementable in different connector designs and enables secondary locking of terminals in the housing.

Objects of this invention have been achieved by providing the short circuit terminal according to claim 1. Disclosed herein is a short circuit terminal stamped and formed from sheet metal, comprising a substantially U-shaped base section extending axially from a wire receiving end to a mating end, the base section having a base wall and side walls extending from opposed lateral edges of the base wall thereby forming the U-shape, the short circuit terminal further comprising at least two spring arms extending from the base section, each spring arm having a contact protrusion for biasing against an electrical terminal mounted in a connector housing, the spring arm further comprising a camming portion for engagement with a release member actuated during coupling of the connector with a complementary connector, wherein the spring arms are stamped out of the base wall, and the spring arm is attached at an attachment portion to the base section, proximate one of said ends of the base section, and the contact protrusion is arranged proximate the other said end of the base section. Advantageously therefore, the U-shaped base section enables a secure and robust seating of the short circuit terminal in a connector housing in a compact manner, whilst the arrangement of spring arms and base section results in low material consumption.

The side walls may be provided with cutouts for receiving a secondary locking protrusion of a connector housing therethrough. Advantageously, the latter enables secondary locking of terminals of a connector housing mounted in the same row as the short circuit terminal, in addition to providing secondary locking for the short circuit terminal if desired. Secure locking of the short circuit terminal in a connector housing is thus provided in a simple manner. Primary locking of the short circuit terminal in the housing may be effected by provision of a resilient locking lance stamped out of the base section for engaging a complementary locking shoulder of the connector housing.

The spring contact arms may be provided in the form of cantilever beams having free ends provided with pre-stress abutment portions for engaging complementary wall portions of a connector housing for limiting outward biasing of the spring contact arms. The latter enables the contact arms to be prestressed such that a high and reliable contact force against terminals in a connector housing can be achieved Further advantageous aspects of this invention will be described in the claims, or will be apparent from the following description and drawings.

BRIEF DESCRIPTION OF THE DRAWINGS

FIG. 4 is a cross-sectional view through the connector;

DETAILED DESCRIPTION OF THE PREFERRED EMBODIMENT

Figure 3:
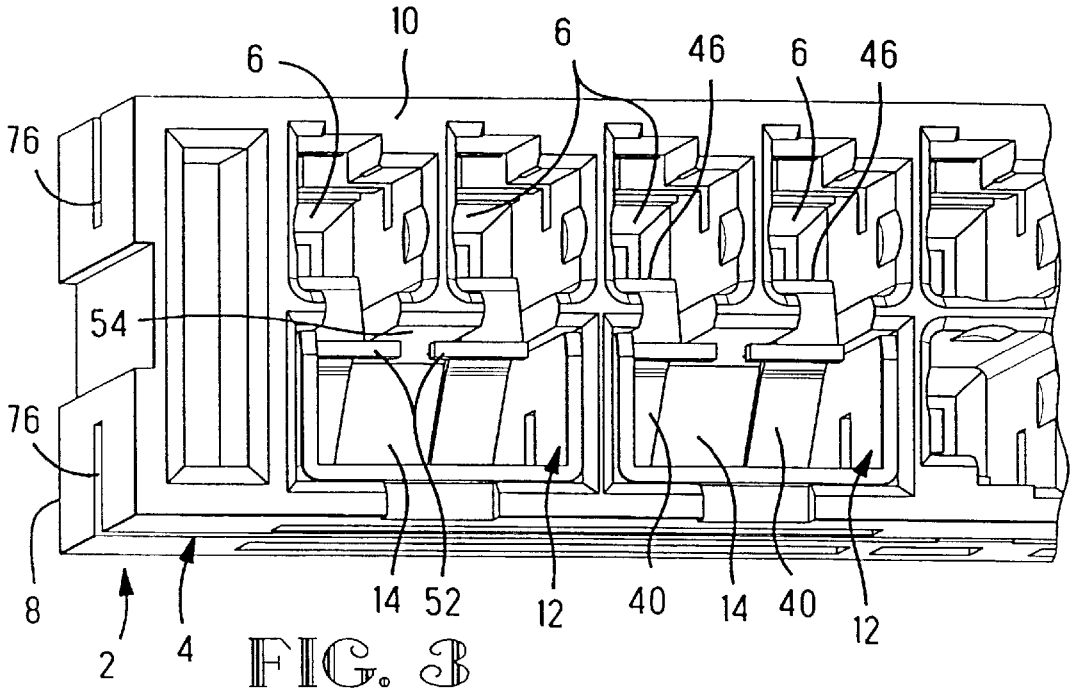
FIG. 3 is an isometric view of a portion of a terminal module according to this invention with short circuit terminals mounted therein, viewed from a terminal receiving end thereof.
Figure 5:
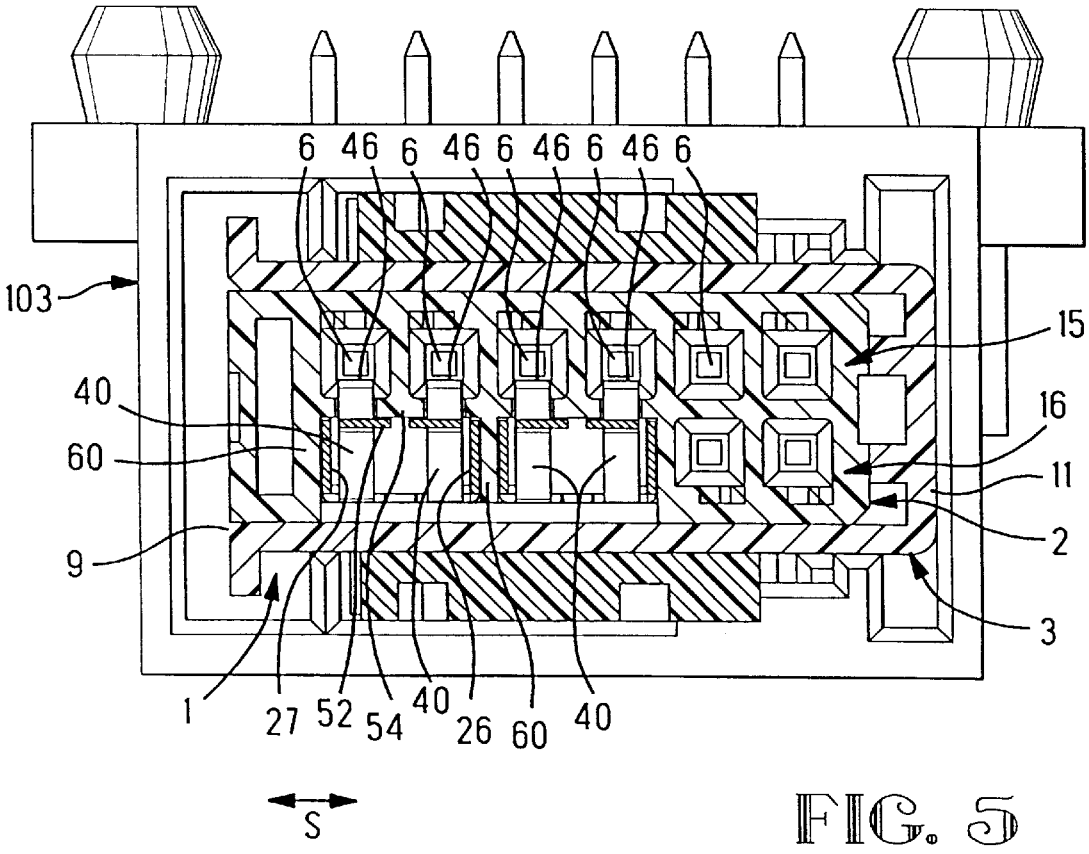
FIG. 5 is a cross-sectional view through lines 5—5 of FIG. 4.

Referring to FIGS. 3–5 a connector 1, comprises a terminal module 2 received within a shell housing 3 that has a module receiving portion 5 and a cable exit portion 7 within which cables terminated to terminals are received and guided out of the connector 1. The module 2 is slidably mounted in the shell housing 3, in a sliding direction orthogonal to a direction of mating M. The sliding direction S is shown in FIG. 5. As best seen in FIG. 5, the module 2 is received into the shell housing 3 through an open end 9 of the shell housing, until abutment with an opposed closed end 11 thereof. In the fully inserted position, the module 2 is locked to the shell housing 3, for example by latches provided on the shell housing and cooperating with complementary latches of the module.

The module 2 comprises an insulative housing 4 having a plurality of terminal receiving cavities 6 extending therethrough from a mating end 8 to a terminal receiving end 10, for receiving electrical terminals. The module further comprises short circuiting terminals 12 received in shunt receiving cavities 14 of the housing 4, the shunt receiving cavities 14 arranged adjacent terminal receiving cavities 6. As best seen in FIGS. 3 and 5, the terminal receiving cavities 6 are arranged in a number of rows 16, 17 (in this embodiment two). The short circuit terminals and corresponding cavities 12, 14 are arranged in one of the rows 16 between terminal receiving cavity 6 and/or shunt receiving cavities 14, depending on which terminals should be short circuited. In the embodiment of FIG. 5, the short circuit terminals 12 are each for short circuiting a pair of terminals inserted in respective adjacent terminal receiving cavities 6, and are arranged in a second row 16 such that two pairs of terminals in the first row 15 would be short circuited. Each short circuit terminal 12 is sufficiently compact such that it occupies the space of no more than two terminals receiving cavities 6 of the connector. A compact arrangement of rows and columns of connector terminals can thus be designed whereby the short circuit terminal 12 can be positioned within the matrix formed by rows and columns in place of a pair of terminal receiving cavity 6. The latter enables a particularly compact connector arrangement with various short circuit configurations to be designed without increasing the size of the connector, or the pitch between rows or between columns.

Figure 1:
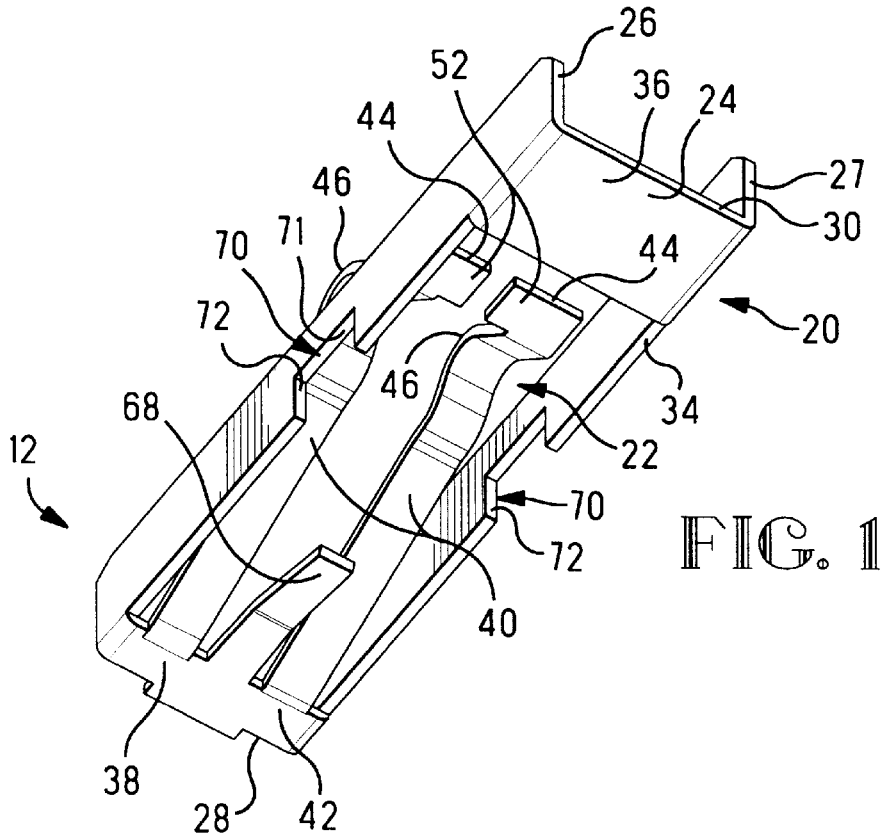
FIG. 1 is an isometric view towards a base wall of a short circuit terminal according to this invention.
Figure 2:
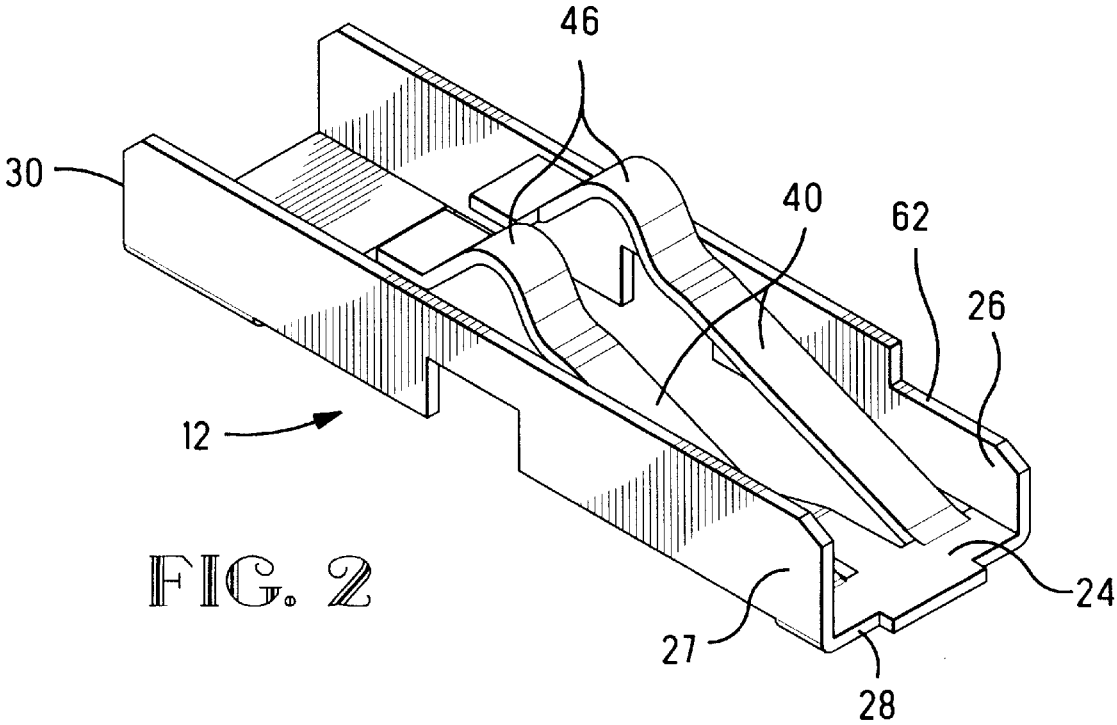
FIG. 2 is an isometric view of the short circuit terminal towards a contacting side.

Referring to FIGS. 1 and 2, the short circuit terminal 12 comprises a base section 20 and a contact section 22, integrally stamped and formed from sheet metal. The base section 20 comprises a U-shaped wall formed by a base wall 24 and side walls 26, 27 extending substantially orthogonally from opposed lateral edges of the base wall 24. The short circuit terminal extends from a mating end 28 to a terminal receiving end 30, the mating end 28 arranged towards the mating end 8 of the connector housing, and the terminal receiving end 28 is directed towards the terminal receiving end 10 of the housing.

The contact section 22 is stamped and formed substantially out of the base wall 24, such that the base wall has a large cutout 34 and the side walls 26,27 are attached to the base wall, at a mating end portion 36 and at a terminal receiving end portion 38 arranged respectively at either end of the cutout 34. The contact section 22 comprises, in this embodiment, two spring arms 40 in the form of cantilever beams, attached at an attachment end 42 to the base section 20, and in particular the base wall 24, and extending therefrom to free ends 44. It would be possible to provide a short circuit terminal with more spring arms for short circuiting a subsequent plurality of terminals, if desired. The spring arms 40 are biased into the U-shape cavity formed by the side walls 26,27 and base wall 24. The base wall portion 36, 38 integral with the side walls 26, 27, forms a compact yet strong support frame for securely locating and holding the contact section 22 in the housing 4.

The spring arms 40 are provided with contact protrusions 46 arranged proximate the free ends 44 for biasing against selected terminals of the connector. As best seen in FIG. 4, the contact protrusions 46 protrude through a cavity 48 in a separating wall 50 between the adjacent terminal receiving cavity 6 and shunt receiving cavity 14. The spring arms 40 further comprise abutment portions 52 extending laterally from the free ends 44 for engaging complementary abutment wall portions 54 (see FIG. 5) of the connector housing. The abutment portions 52 limit deflection of the contact portions 46 into the terminal receiving cavity 6. The spring arms 40 can be prestressed such that a high spring force is generated for high contact pressure of the contact protrusion 46 against a terminal mounted in cavity 6. The latter improves the electrical connection between the short circuit contact and the terminal, and ensures a more reliable contact. Positive seating of the abutment portions 52 against the housing abutment portion 54 positions the contact protrusion 46 within the terminal receiving cavity 6 such that abutment against a terminal inserted in the cavity 6 is guaranteed with a minimum contact pressure. The spring arms 40 extend from one side of the shunt receiving cavity 14, across to the opposed side of the cavity 14 formed by the separating wall 50, as best seen in FIG. 4.

In order to disconnect the short circuit connection between terminals mounted in the cavity 6, a complementary mating connector 103 is provided with a release member 100 in the form of a peg which inserts into the shunt receiving cavity 14 and engages the spring arm 40 for breaking the short circuit connection. The spring arms 40 thus also act as effective camming portions due to the gentle oblique slope traversing the cavity 14.

The U-shaped base section 20 is lodged within the receiving cavity 14 such that the side walls 26,27 are seated contiguously against side walls 60 of the housing shunt receiving cavities. As best seen in FIG. 2, proximate the mating end 28 of the base section 20, the side walls 26, 27 are provided with a polarising feature 62 in the form of a cutout extending from the mating end 28 such that the side wall 26 has a height above the base wall 24 different from the opposite side wall 27, at the mating end 28. The polarising feature may be useful in ensuring that the short circuit terminal 12 cannot be inserted incorrectly, for example with the terminal receiving end 30 directed towards the connector mating end 8.

The short circuit terminal 12 is inserted into the shunt receiving cavity 14 of the housing 4 from the terminal receiving end 10 until abutment of the mating end 28 with the front end 66 of the housing. In the fully inserted position, a resilient locking lance 68 stamped and formed from the base wall 24 engages a complementary locking shoulder 102 of the housing. The locking lance 68 forms primary locking means for securing the short circuit terminal 12 in the housing 4. The locking lance 68 is stamped from material arranged between the two spring arms 40, and similarly extends from the mating end portion 38 of the base section 20. The short circuit terminal 12 is further provided with cutouts 71 in the side walls 26,27, the cutouts forming locking shoulders 72 engageable with complementary secondary locking members 74 (see FIG. 4) of the connector. The secondary locking members 74 are slidably received in a corresponding recess 76 of the housing that extends perpendicularly to a direction of insertion (M) of the terminals into the cavity 6,14. The secondary locking member 74 will also engage behind shoulders of the terminals, once the terminals are fully inserted within the module housing 4.

The secondary locking members 74 are in this embodiment in the form of continuous bars that extend integrally from opposed side walls 78 of the shell housing 3, and engage behind shoulders of terminals mounted in the module housing, when the module housing is assembled to the shell housing 3. In other words, terminals will be fully mounted to the module housing 4 prior to insertion of the module housing 4 into the shell housing 3. It is also possible however to provide the secondary locking members 74 with gaps therebetween such that the module housing 4 is preassembled to the shell housing 3 in a preassembly position, enabling insertion of terminals into the cavity 6, subsequently displacing the module housing 4 to the fully locked position such that the portions engage behind the terminals. The cutouts 71 in the short circuit terminal enables movement of the secondary locking members 74 of the housing in the sliding direction S of the secondary locking member whilst providing a compact connector with short circuit terminals arranged therein. In addition, the cutouts 71 provide additional security for ensuring full insertion and secure locking of the short circuit terminals in the housing.

What is claimed:

1. A short circuit terminal comprising:

a base section stamped and formed of sheet metal, said base section extending axially from a terminal receiving end to a mating end, the base section having a base wall and side walls extending substantially orthogonally from opposed lateral edges of said base wall to form a U-shape; and at least two resilient spring arms stamped out of said base wall to form a cutout in the base wall that is larger than the two spring arms, thereby defining a mating end portion of the base wall, wherein each spring arm comprises an attachment portion that is connected to the mating end portion of the base wall at the cut out and each spring arm extends away from the base wall at an acute angle to a contact protrusion that is located towards the terminal receiving end for engaging an electrical terminal to be mounted in the connector housing, and a camming portion located between the attachment portion and the contact protrusion, whereby a release member associated with a complementary connector to the connector containing the short circuit terminal engages the camming portion during mating of the connector and the complementary connector to deflect the arms towards the base wall.

2. The short circuit terminal of claim 1 wherein the spring arms are cantilever beams extending from the attachment portion to free ends, whereby the contact protrusions are arranged proximate the free ends.

3. The short circuit terminal of claim 2 wherein the spring arms comprise prestress abutment portions arranged proximate the free ends, for engagement against a complementary abutment wall portion of a connector housing, such that the spring arms can be prestressed when inserted into the connector housing.

4. The short circuit terminal of claim 3 wherein the prestress abutment portions extend laterally from proximate the free ends, the abutment portions arranged between the free ends and contact protrusions.

5. The short circuit terminal of claim 1 wherein the side walls comprise side-wall cutouts extending from the base wall, the side-wall cutouts enabling passage of a terminal secondary locking member therethrough.

6. The short circuit terminal of claim 5 wherein the side-wall cutouts are substantially centrally arranged between said ends of the base section.

7. The short circuit terminal of claim 5 wherein the side-wall cutouts are provided with locking shoulders for engaging a secondary locking member of a connector housing, the short circuit terminal further comprising a locking lance forming primary locking means, for securing the short circuit terminal in a connector housing.

8. A connector comprising a short circuit terminal according to any one of the preceding claims, wherein the connector comprises at least two rows of terminal receiving cavities in a housing, and one or more shunt receiving cavities arranged in at least one of the rows of terminal receiving cavities, the shunt receiving cavities occupying the space of a number of terminal receiving cavities equivalent to the number of terminal to be short circuited by a said short circuit terminal received in said shunt receiving cavity.

9. The connector of the preceding claim wherein the mating end of the base section is arranged proximate a mating end of the housing, and wherein the contact protrusions of the short circuit terminal are arranged proximate the terminal receiving end of the base section remote from the mating end.

10. The connector of claim 8, wherein the housing and cavities in which connector and short circuit terminals respectively are mounted, forms a module that is slideably insertable in a shell housing, the shell housing comprising secondary locking members slideably received in recesses extending along sides of the housing substantially in alignment with the cutouts of short circuit terminals inserted in the module.

* * * * *